United States Patent [19]

Fisher

[11] 4,212,341

[45] Jul. 15, 1980

[54] SUN SCREEN BLINDS AND THE LIKE

[75] Inventor: Eric V. Fisher, Earlwood, Australia

[73] Assignee: Impact Products Pty. Ltd., Australia

[21] Appl. No.: 902,549

[22] Filed: May 3, 1978

[51] Int. Cl.[2] ..... E05B 3/94

[52] U.S. Cl. ..... 160/84 R

[58] Field of Search ..... 160/84 R

[56] References Cited

U.S. PATENT DOCUMENTS

| | | | |
|---|---|---|---|
| 354,450 | 12/1886 | Tripp | 160/84 R |
| 1,548,523 | 8/1925 | Friend | 160/84 R |
| 2,247,260 | 6/1941 | Stone | 160/84 R |
| 3,465,806 | 9/1969 | Sulkes | 160/84 R |
| 3,734,809 | 5/1973 | Ellis | 160/84 R |

*Primary Examiner*—Peter M. Caun

*Attorney, Agent, or Firm*—Steinberg and Blake

[57] ABSTRACT

An apparatus particularly suitable for sun screen blinds having two housings with at least a length of extensible cord fitted therebetween such that a portion of said cord is stored in a housing and may be withdrawn as the blind is opened. A collapsible sun screen is fitted between the housings and is connected to each housing.

4 Claims, 5 Drawing Figures

SUN SCREEN BLINDS AND THE LIKE

The present invention relates to sun screen blinds and more particularly to means for making such blinds collapsible and extensible.

In known constructions for blinds having the aforementioned capabilities various forms of mechanical means requiring cords, pulleys, winding devices and the like are required which unduly complicate manufacture of the blinds or sun screens and which when they deteriorate require skilled maintenance procedures.

It is an object of the present invention to provide a collapsible and extensible means suitable for sun screen blinds and the like.

A further object of the present invention resides in such means as having stored extensible cord means which may be readily serviced and maintained.

In one form the present invention provides apparatus for extending or retracting such as a sun screen blind, divider, partition or the like, said apparatus comprising two housing members wherein at least one housing member comprises a storage of extensible cord means which is withdrawable from and retractable into said at least one housing, said extensible cord means being connected to said other housing and the portion of said cord means between said two housings being adapted to locate an expansible and collapsible screen member.

In a particularly preferred form the cord means is in the form of an elasticized cord and so that adequate separation of the two housings can be achieved there may be a plurality of loops of the elasticized cord stored in one or both of the housings.

A further form contemplates a reel storage for the extensible cord wherein the reel is located within at least one of the housing members and biased to roll up and store the cord which can be fed from the reel against the action of the bias.

Apparatus in accordance with the invention is particularly suited to providing a means for positioning a sun screen blind in motor vehicles as well as domestic applications and the like. In a motor vehicle, one housing member may be attached to the passenger side pillar of a car and when the blind is not required it is stored between the two housing members which are secured together. The blind preferably comprises a concertina folded screen threaded on the extensible cord. When it is desired to operate the blind to cover the interior of the windscreen and shade the cabin the other housing member is drawn across the windscreen and attached to the opposite pillar so that the concertina-folded screen is drawn across the windscreen of the car to reflect radiant energy and reduce the heating of the cabin of the vehicle when parked in the open on a sunny day.

The present invention will now be described by way of example with reference to the accompanying drawings, in which.

Figure 1:
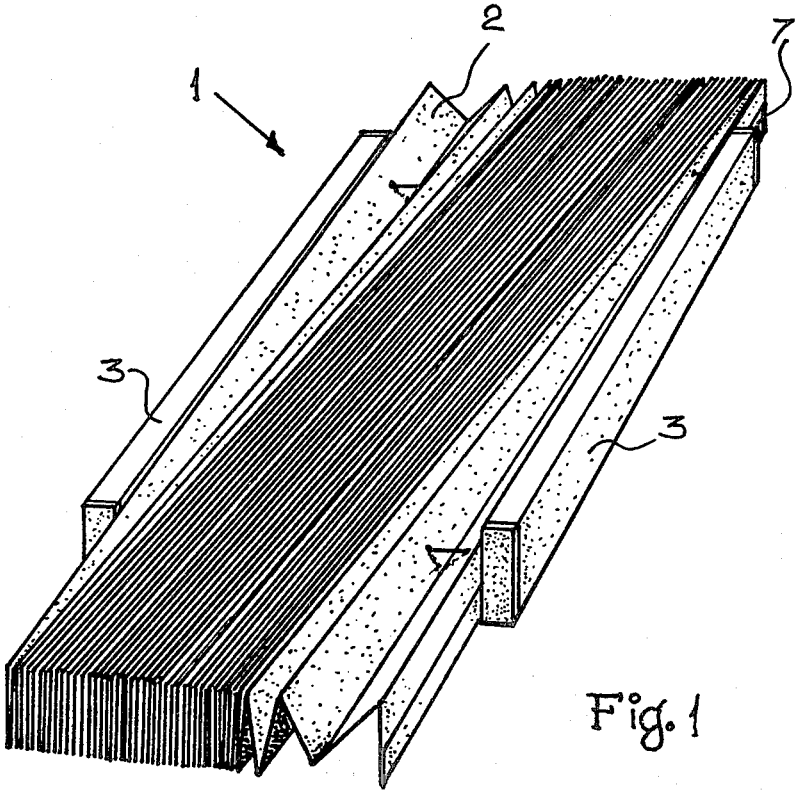
FIG. 1 is a perspective view of a mechanism in accordance with the invention incorporating a sun screen.
Figure 2:
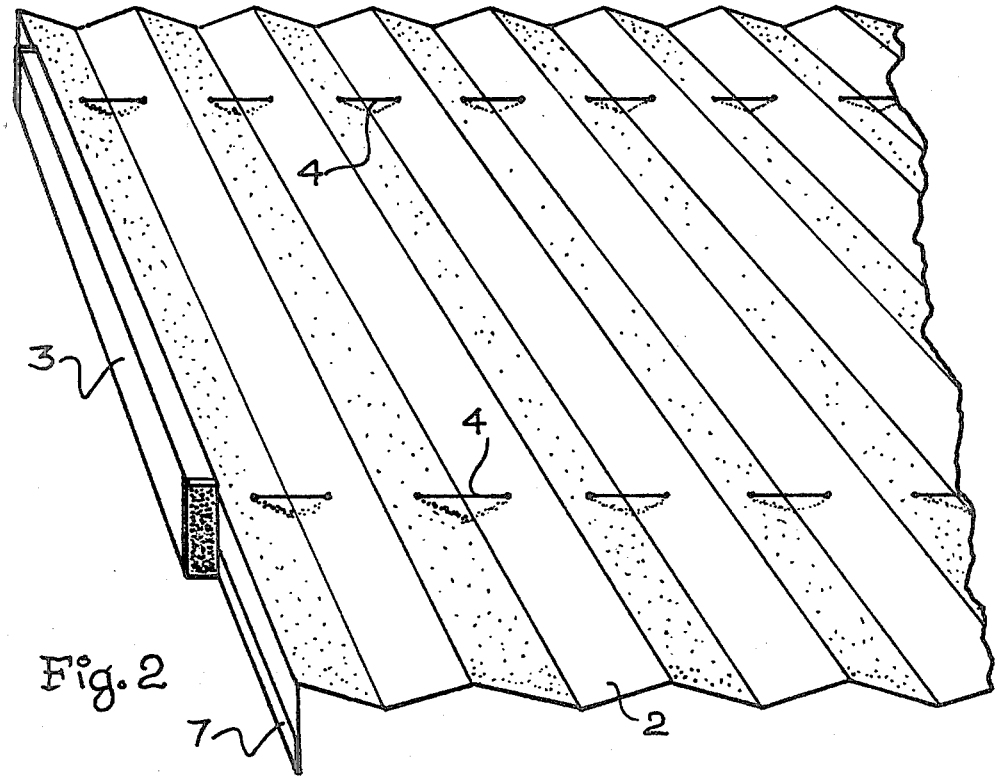
FIG. 2 is a fragmentary perspective view of the arrangement of FIG. 1 wherein the screen is fully extended.

In the drawings, and firstly FIG. 1 there is shown a sun screen blind 1 wherein a mechanism of the present invention facilitates the expansion and contraction of the screen 2. The blind comprises two housing members 3 located at opposite ends of the screen 2. Interconnecting the housing members 3 is an elasticized cord 4 having a circuitous path as can be seen from FIG. 3. The elasticized cord describes a path wherein when the blind is in its closed condition, substantially as shown in FIG. 1, there is substantially no residual tension in the cord acting to draw together the housing members 3.

Figure 3:
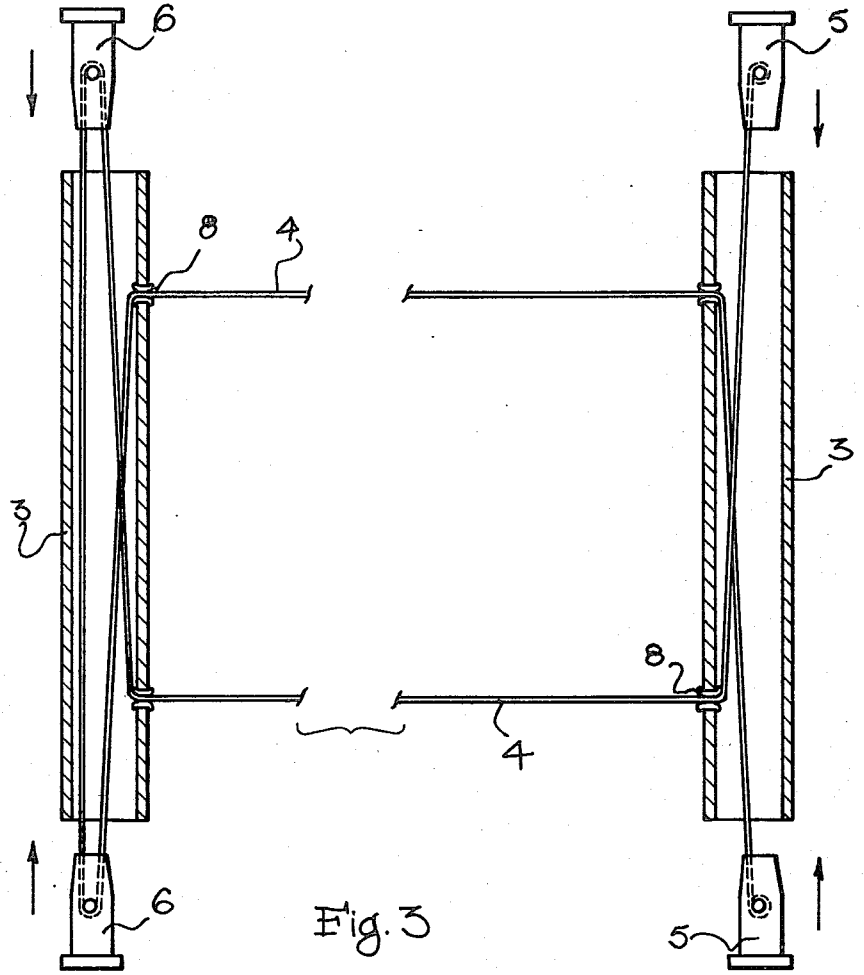
FIG. 3 is an elevation, cross sectional view of the mechanism of FIG. 1.

The amount of permissible separation of the housing members as shown in FIG. 3 is limited by the extensibility of the cord 4 and the amount of cord stored in the housing housing members 3. As shown in FIG. 3 the cord 3 is attached to end plugs 5 in one housing member 3 and follows a path which provides a single loop or coil between the two end plugs 6 in the other housing member. To increase the permissible separation it is only required to provide additional loops of elasticized cord between the end plugs 6.

The screen 2 of this embodiment is concertina folded and comprises stiffness members 7 so as to maintain the screen in a neat condition and prevent fanning of its ends when in a folded condition as shown in FIG. 1.

Figure 4:
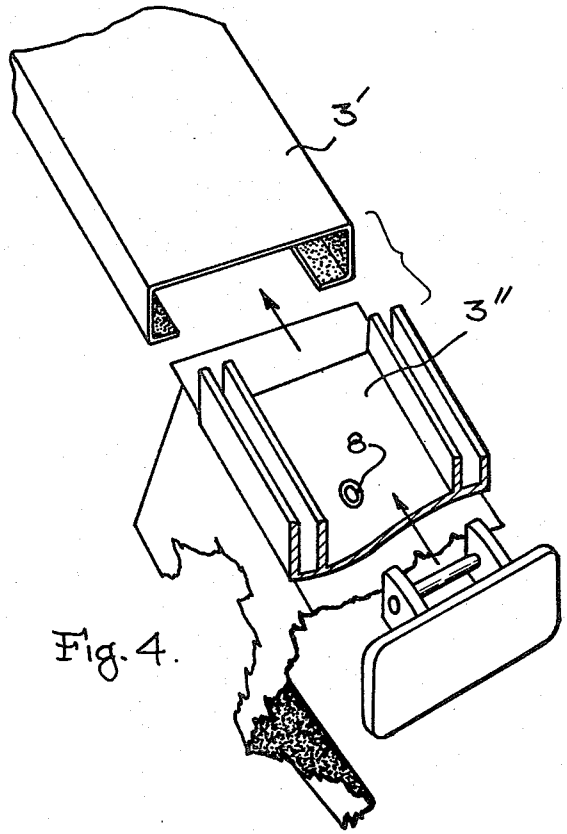
FIG. 4 is an exploded perspective view of a housing member.

FIG. 4 shows the manner in which the blind of FIG. 1 is assembled. The housing 3 comprises an outer extruded channel section 3' and an inner extruded section 3'' adapted to be slidably received in section 3'. In addition the screen 2 is adapted to be retained between the sections 3' and 3'' as they are fitted together thereby preventing its undesired separation from the housing 3. The holes 8 in the housings 3 are preferably fitted with eyelets to allow smooth feeding of the elasticized cord 4.

Figure 5:
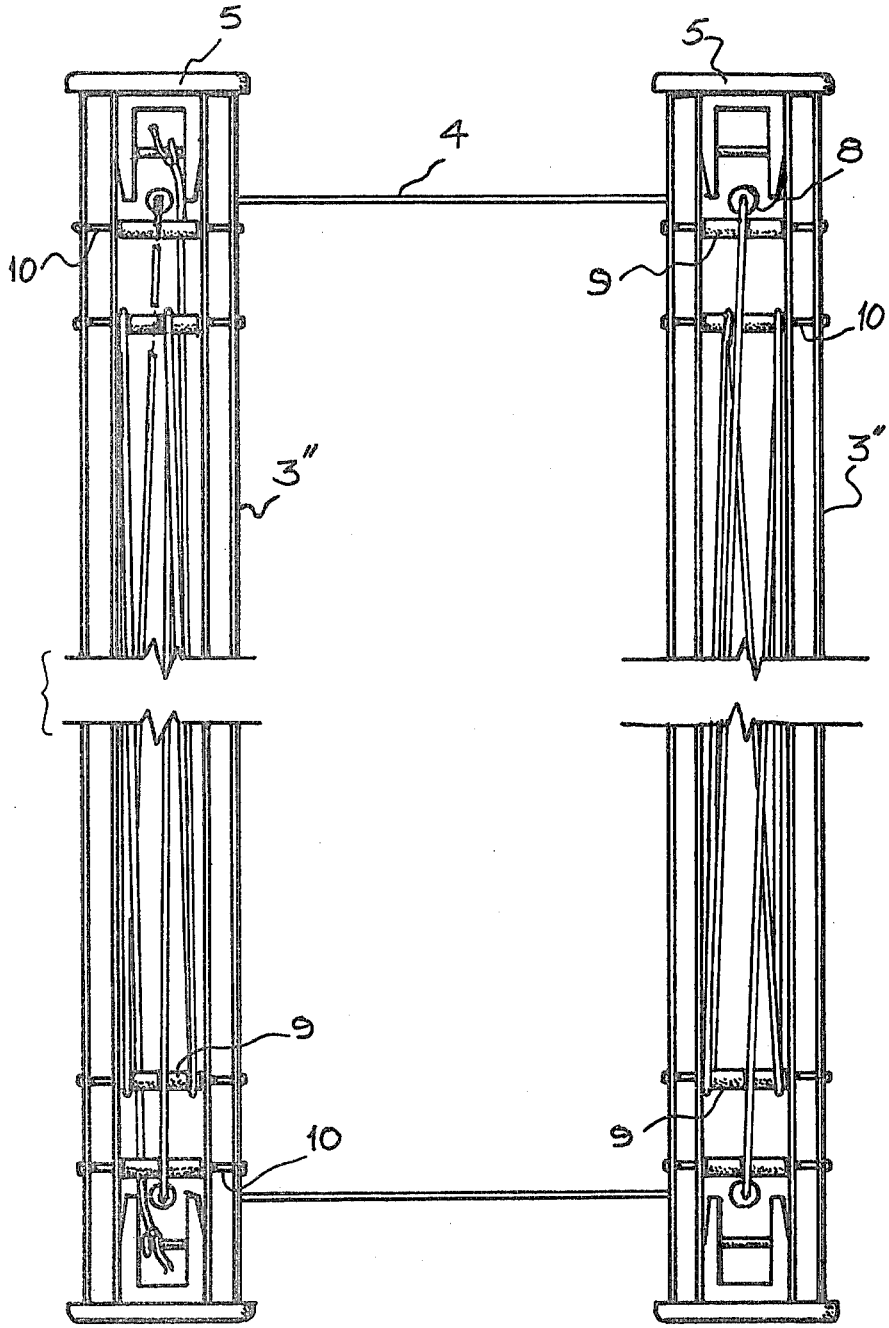
FIG. 5 is cutaway elevation view of another embodiment of a mechanism in accordance with the present invention.

The embodiment of FIG. 5 is an improved form and is shown in an assembled condition with the rear of the housings 3 removed and facing out of the page. In this arrangement there is a storage of elasticized cord 4 in each of the housings 3'' and the feeding of the cord 4 passes over rollers 9 on pins 10 passing through the housing members 3. By using the rollers which are preferably axially divided the cord 4 is able to run much more freely than in the first embodiment so that the life of the cord is substantially prolonged. It will be appreciated that the number of coils in each or both housings 3 may be increased or decreased as required in dependance upon the amount of separation of the housings that is desired.

Thus, it is seen that a structure is provided which includes elasticized cord means which are stored in at least one of the housings by being looped therewithin and wherein the sole means for retracting the sun screen comprises the looped elasticized cord. Thus, upon extension of the sun screen, energy is stored within the elasticized cord means due to its corresponding extension so that no additional mechanical means are required to retract the screen.

A particularly advantageous use of the apparatus of the present invention when employed in a sun screen blind is as a means for screening sun from the interior of vehicles. In this use one housing member 3 is secured to a pillar at one side of a car's windscreen and the other housing member 3 is secured thereto with the folded screen 2 therebetween. When it is desired to screen the windshield the other housing member 3 may be separated from the one housing member and drawn across the glass area inside the vehicle and secured to the other pillar. In this way the screen 2 effectively shields the glass area of the windshield and so reduces the heat build up inside the vehicle as occurs on hot days. To remove the screen it is only necessary to free the other housing member and allow the screen to retract under the action of the cord 4 and then secure the other housings. A desirable means for securing the housings in the collapsed and extended states of the screen comprises Velcro fasteners.

I claim:

1. Apparatus for extending or retracting such as a sun screen blind, divider, partition or the like, said apparatus comprising; a single length of elastized extensible cord means; two housing members wherein at least one housing member has stored therein a looped portion of said single length of elasticized extensible cord means; the end portions of said looped portion of said single length of cord means extending from two mutually spaced locations on said at least one housing member so that said cord means is withdrawable from and retractable into said at least one housing member through said spaced locations, the ends of said single length of extensible cord means being connected to said other housing member; an expansible and collapsible screen member located on the portions of said cord means between said two housing members and wherein said looped elasticized cord means comprise the sole means for supplying a force for retracting said screen member upon said cord means being extended from its unstretched position so that the tension at all points on said single length of elasticized extensible cord means is maintained substantially the same upon extension or retraction of said apparatus.

2. Apparatus as claimed in claim 1 wherein said extensible cord means is stored in said at least one housing member by being looped about two spaced apart rods in said housing member.

3. Apparatus as claimed in claim 1 wherein said extensible cord means is looped about rollers fitted on spaced apart rods fixedly mounted in said at least one housing member.

4. Apparatus as claimed in claim 1 wherein said sun screen is concertina folded.

* * * * *